US010633905B2

(12) United States Patent
Feng

(10) Patent No.: US 10,633,905 B2
(45) Date of Patent: Apr. 28, 2020

(54) COMBINED DOOR HINGE WITH VARIABLE HYDRAULIC DAMPING AND STOPPER DEVICE PERFORMANCE

(71) Applicant: Huaigang Feng, Donnuggan (CN)

(72) Inventor: Huaigang Feng, Donnuggan (CN)

( * ) Notice: Subject to any disclaimer, the term of this patent is extended or adjusted under 35 U.S.C. 154(b) by 0 days.

(21) Appl. No.: 16/155,428

(22) Filed: Oct. 9, 2018

(65) Prior Publication Data

US 2019/0040667 A1 Feb. 7, 2019

Related U.S. Application Data

(63) Continuation-in-part of application No. 15/437,010, filed on Feb. 20, 2017, now abandoned.

(51) Int. Cl.

| | |
|---|---|
| ***E05F 3/22*** | (2006.01) |
| ***E05F 3/20*** | (2006.01) |
| ***E05D 3/02*** | (2006.01) |
| ***E05F 1/12*** | (2006.01) |
| ***E05F 3/14*** | (2006.01) |

(52) U.S. Cl.

CPC ..... *E05F 3/20* (2013.01); *E05D 3/02* (2013.01); *E05F 1/1223* (2013.01); *E05F 3/14* (2013.01); *E05Y 2201/492* (2013.01); *E05Y 2900/132* (2013.01)

(58) Field of Classification Search

CPC . Y10T 16/283; Y10T 16/304; Y10T 16/2771; Y10T 16/5387; Y10T 16/537; Y10T 16/5373; Y10T 16/53888; Y10T 16/2766; E05F 1/066; E05F 1/1008; E05F 1/12; E05F 1/1207; E05F 1/1223; E05F 3/00; E05F 3/04; E05F 3/10; E05F 3/12; E05F 3/20; E05F 5/00; E05D 3/02; E05D 11/02; E05D 11/04; E05D 11/084; E05D 11/1014; E05D 7/12; E05D 2005/108; E05Y 2800/00; E05Y 2201/21; E05Y 2201/264; E05Y 2201/628;

(Continued)

(56) References Cited

U.S. PATENT DOCUMENTS 1,824,217 A * 9/1931 Kreiner ..... E05F 3/20 16/54
1,927,778 A * 9/1933 Hirakawa ..... E05F 3/20 16/54

(Continued)

*Primary Examiner* — Chuck Y Mah

(74) *Attorney, Agent, or Firm* — Southeast IP Group, LLC.; Thomas L. Moses

(57) ABSTRACT

An apparatus combining a door hinge and a door closer is provided. In one embodiment, the hinge provides a variable hydraulic damping speed control with spring action closing, as well as an optional stop action. In one embodiment, the hinge of the present invention includes an adjustable compression spring to operate the opening and closing of the door. After the door has closed to approximately 20 degrees or so, the hydraulic component of the door may then control the speed of the door preferably from approximately 20 degrees until closed. The hydraulic component can also be adjusted to vary the speed and force of the door opening and closing. A pair of magnets may be present in the control cylinder of the hinge to provide more force to complete the closing function. Additionally, a stop function allows for the door to remain open and in place in one embodiment.

9 Claims, 7 Drawing Sheets

(58) Field of Classification Search
CPC ..... E05Y 2201/638; E05Y 2201/256; E05Y 2900/132
See application file for complete search history.

(56) References Cited

U.S. PATENT DOCUMENTS

| | | | | | |
|---|---|---|---|---|---|
| 2,118,950 | A * | 5/1938 | Stannard | E05F 3/20 | 16/256 |
| 2,456,537 | A * | 12/1948 | Seaman | E05F 3/10 | 16/54 |
| 4,358,870 | A * | 11/1982 | Hong | E05F 3/20 | 16/53 |
| 4,829,628 | A * | 5/1989 | Vuksic | E05F 3/20 | 16/299 |
| 5,152,029 | A * | 10/1992 | Pai | E05D 5/10 | 16/54 |
| 5,195,210 | A | 3/1993 | Lee | | |
| 5,572,768 | A * | 11/1996 | Daul | E05F 1/1215 | 16/337 |
| 6,658,694 | B2 | 12/2003 | Wang | | |
| 8,898,860 | B2 | 12/2014 | Bacchetti | | |
| 8,943,652 | B2 | 2/2015 | Bacchetti | | |
| 9,926,732 | B2 * | 3/2018 | Bacchetti | E05F 3/04 | |
| 2004/0068833 | A1 * | 4/2004 | Sawa | E05F 3/20 | 16/60 |
| 2004/0250377 | A1 | 12/2004 | Park | | |
| 2009/0241289 | A1 * | 10/2009 | Choi | E05F 3/20 | 16/275 |
| 2010/0024159 | A1 | 2/2010 | Oh et al. | | |
| 2010/0263289 | A1 * | 10/2010 | Sawa | E05F 1/1223 | 49/386 |
| 2010/0319260 | A1 * | 12/2010 | Sawa | E05F 1/1223 | 49/326 |

* cited by examiner

COMBINED DOOR HINGE WITH VARIABLE HYDRAULIC DAMPING AND STOPPER DEVICE PERFORMANCE

CROSS REFERENCE TO RELATED APPLICATIONS

The present application is a continuation in part of U.S. application Ser. No. 15/437,010, entitled Combined Door Hinge with Variable Hydraulic Damping and Stopper Device Performance, filed on Feb. 20, 2017. All of the foregoing applications are hereby incorporated by reference in their entireties.

BACKGROUND OF THE INVENTION

A conventional hinge device generally includes a stationary hinge member that is mounted on a door frame, and a rotatable hinge member that is mounted on a door and capable of being pivoted to the stationary hinge member so as to permit rotation of the door between open and closed positions relative to the door frame.

Many patents and publications, several incorporated herein by reference, describe door hinges as well as improvements on typical door hinges. Such improvements include hydraulic door closers, compression springs, and the like, installed within the hinge to facilitate opening and closing of a door.

Unfortunately, the automatically closing door with the conventional hydraulic hinge of the related art is uneconomical since the maintenance/repair job is expensive to perform due to the vulnerable structural strength and durability resulting from the use of the loose spring of the hinge and the leakage of the oil pressure and the like, due to the increasing opening/closing of the door. Further, since the hydraulic cylinder, the hinge axle member interlocked with the hydraulic cylinder, and the drive members are linked in a complicated manner with so many complex parts, they are the main causes of increased production cost together with the associated economic burden from the high production cost and inefficiency of a mass production. The durability is also shortened because the risks of a malfunction or breakdown may be increased due to the many numbers of linked parts as well as the decreased easy assembly of them. The references provided herein are hereby incorporated by reference, in their entireties.

U.S. Pat. No. 4,756,051 describes a door-closer hinge that includes a first flap secured to a door, a second flap secured to a door frame, and an automatic closer as restored by a restoring spring and having a longitudinal casing secured to the second flap. A a rotor vane is operatively rotated with respect to a cylinder vane fixed inside a cylinder filled with hydraulic oil to thereby form a rotary-movement shock absorber.

U.S. Pat. No. 6,658,694 describes a hinge member that includes a rotatable cam element with a first cam face and a slidable cam element with a second cam face. A biasing member is connected to the slidable cam element so as to accumulate a returning force when the second cam face moves away from the first cam face and so as to urge the second cam face to move toward the first cam face when the external force ceases to be applied on the rotatable cam element.

U.S. Pat. No. 8,898,860 describes a hinge device for rotatably moving a closing element includes a fixed element anchorable to a stationary support structure coupled to a movable element anchorable to the closing element for rotating around a first longitudinal axis between an open position and a closed position. The device further includes at least one slider movable along a second axis between a compressed and an extended position. One between the movable element and the fixed element includes at least one operating chamber defining the second axis so as to slidably house the slider, the other element including a pivot defining the first axis. The pivot and the slider are reciprocally coupled so that to the rotation of the movable element around the first axis corresponds the sliding of the slider along the second axis and vice versa.

U.S. Pat. No. 8,943,652 describes a hinge for cold rooms, swing gates or the like includes a stationary support structure and at least a door movable between an open door position and a closed door position. The hinge comprises a box-like hinge body and a pin rotatably coupled to rotate about a first axis between the open door position and the closed door position. Closing means are provided for automatically returning the door, as well as a working fluid acting thereon to hydraulically contrast their action. The closing means comprise a cam element unitary with the pin interacting with a plunger element housed in an operating chamber defined within the box-like hinge body. The box-like hinge body has an elongated shape to define a second axis perpendicular to the first axis.

U.S. Patent Publication No. 2004/0250377 describes a multipurpose hinge apparatus having an automatic return function is provided in which the apparatus is installed between the door and a main body. The apparatus includes a driving mechanism for ascending and descending a piston rod according to opening and closing of the door which is installed in the upper portion of a cylindrical housing. A piston is connected with the piston rod, in which a one-direction check valve is installed in the piston. The piston partitions an upper chamber and a lower chamber and ascends and descends in association with the piston rod. A first oil path communicates with the upper and lower chambers via the lower portion of the piston rod in the central portion of the piston. A compression spring which makes the piston ascend is inserted into the lower chamber. Oil is filled in the chamber. Thus, the hinge apparatus is automatically returned to the initial position with return speed in multiple steps by controlling an amount of oil flowing from upper chamber to lower chamber in multiple steps when a door is closed.

In light of the current state of the art, it would be advantageous to provide a door hinge that that is less expensive to produce and repair and has an increased durability, yet still performs the functions of a more technologically advanced hinge, such as hydraulic dampening and built-in stopper function. It would also be advantageous to provide a low profile door hinge with the aforementioned functions that further includes adjustability features such that the rate of speed and strength of opening and closing could be varied as desired according to the door use and function.

BRIEF SUMMARY OF THE INVENTION

One object of the present invention is to provide a door hinge that combines a door hinge and a door closer into a single apparatus. The hinge of the present invention provides a variable hydraulic damping speed control with spring action closing, as well as an optional stop action.

In one embodiment, the hinge of the present invention includes an adjustable compression spring to operate the opening and closing of the door, preferably when the door is between approximately 90 degrees and 20 degrees. The spring can be adjusted to control the speed and strength of the door opening and closing. After the door has closed to approximately 20 degrees or so, the hydraulic component of the door may then control the speed of the door preferably from approximately 20 degrees until closed (0 degrees). The hydraulic component can also be adjusted to vary the speed and force of the door opening and closing.

Both the compression spring and hydraulic damper may be adjusted and controlled through the use of an adjustment pin that may be inserted into the top or bottom cap of the door hinge and then turned clockwise or counter-clockwise depending on the desired adjustment. In a preferred embodiment, a magnet may be present in the control cylinder of the hinge to provide more force to complete the closing function. Additionally, a stop function allows for the door to remain open and in place at any desired position, preferably when the door is open beyond approximately 85 degrees, or as desired.

DESCRIPTION OF THE DRAWINGS

These and other features, aspects, and advantages of the present invention will become better understood with regard to the following description, appended claims, and accompanying drawings where:

DETAILED DESCRIPTION OF THE INVENTION

Figure 1:
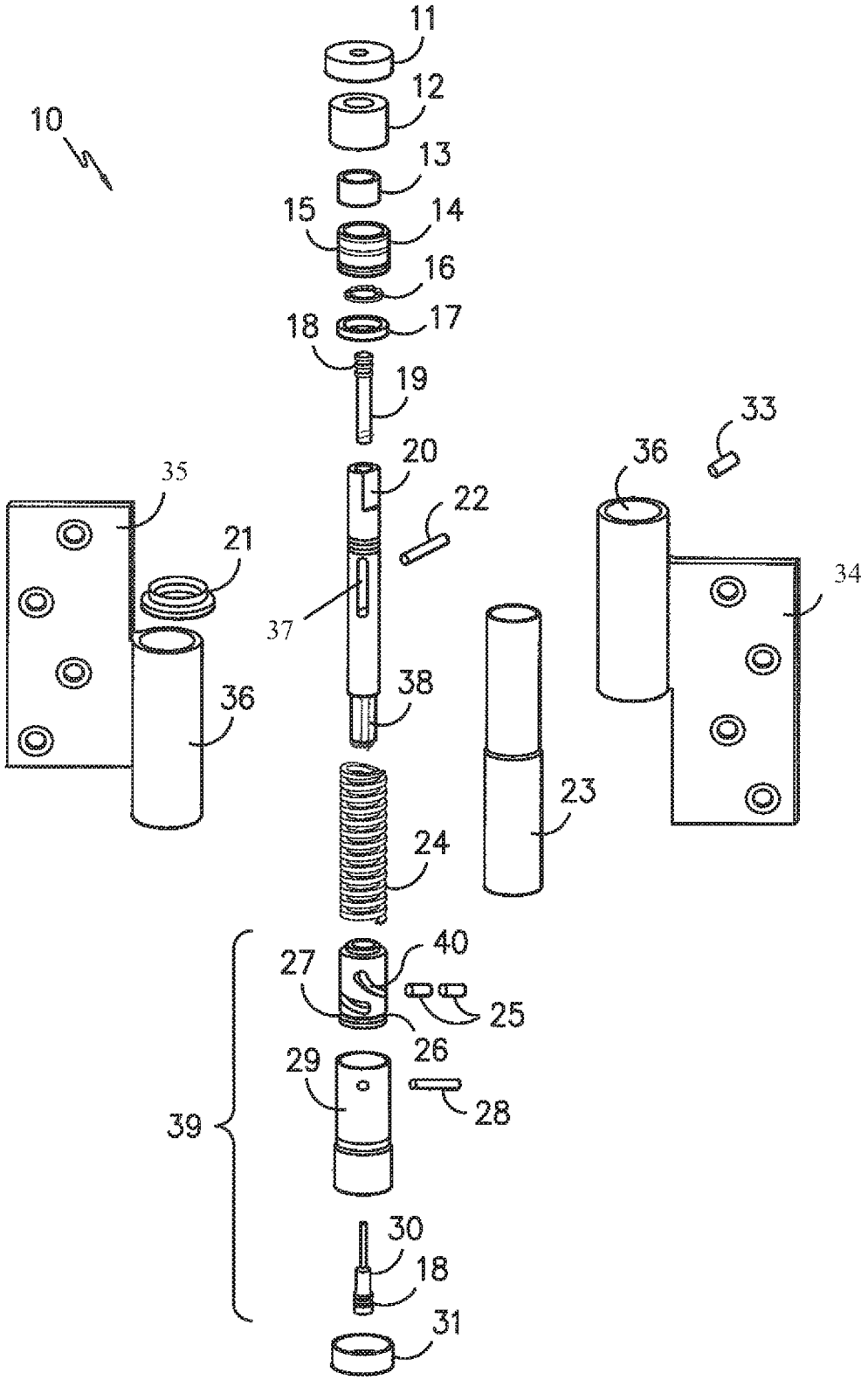
FIG. 1 is an exploded view of one embodiment of the door hinge of the present invention.
Figure 2:
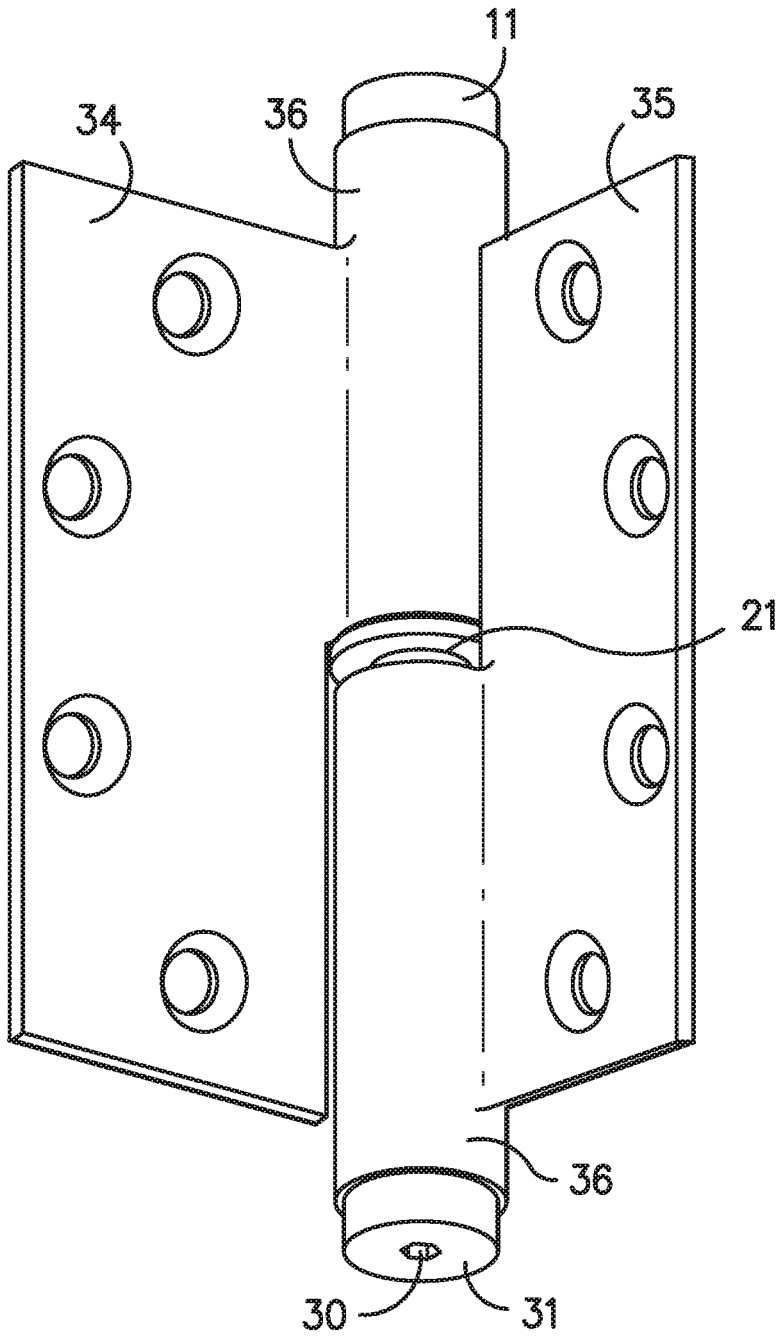
FIG. 2 is a perspective view of one embodiment of the present invention showing the door hinge in an open position.
Figure 3:
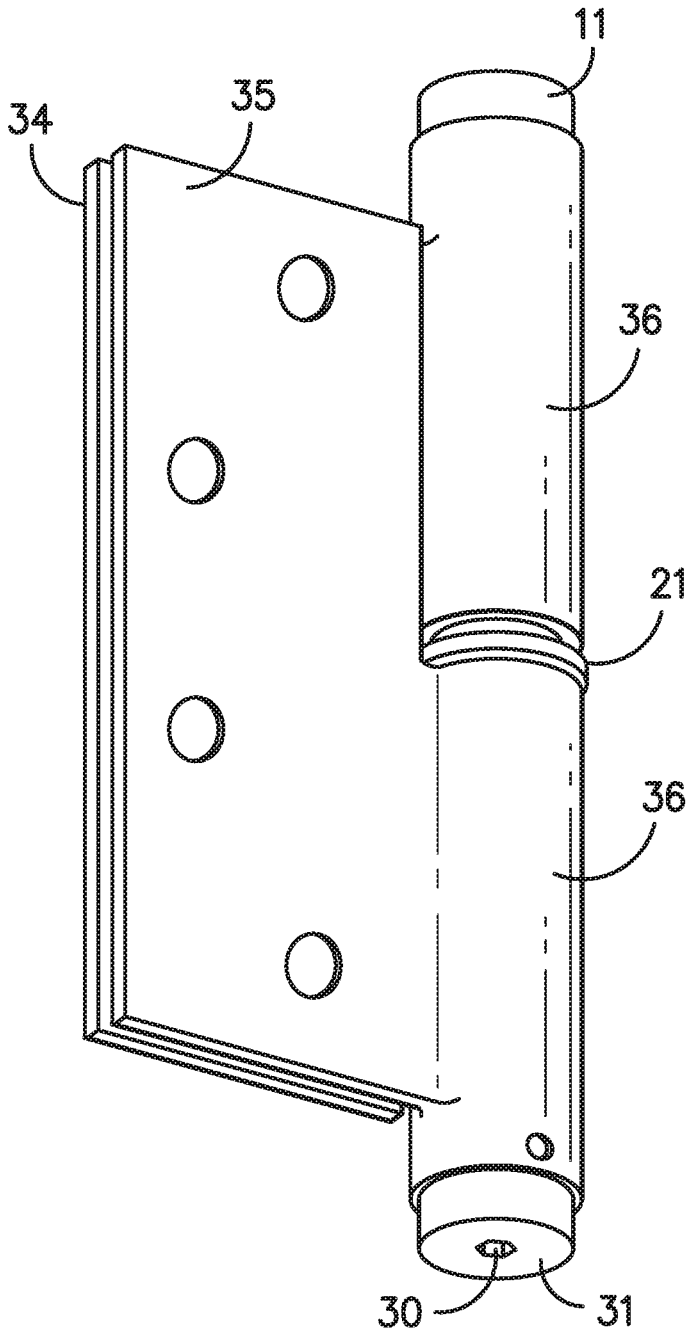
FIG. 3 is a perspective view of one embodiment of the present invention showing the door hinge in a closed position.
Figure 4:
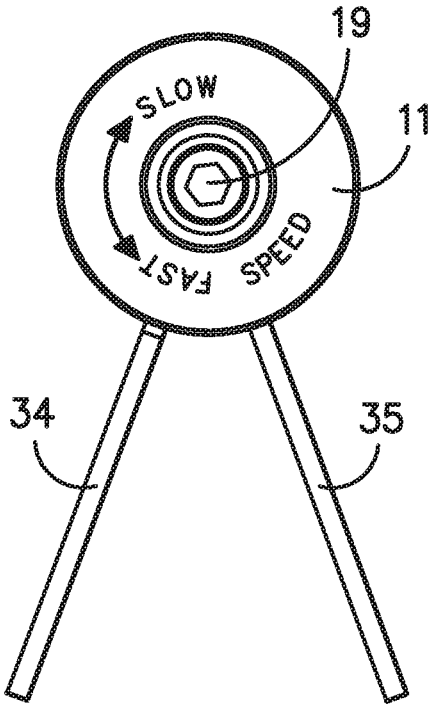
FIG. 4 is a bottom view of one embodiment of the present invention showing the bottom cap of the door hinge, whereby hydraulic adjustment may occur.
Figure 5:
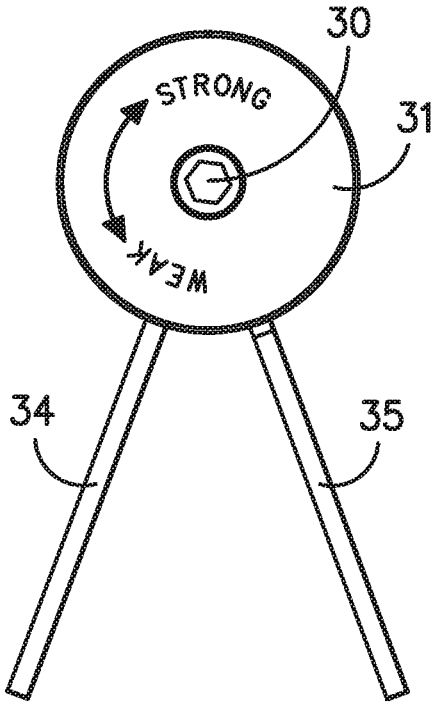
FIG. 5 is a top view of one embodiment of the present invention showing the top cap of the door hinge, whereby compression spring adjustment may occur.
Figure 6:
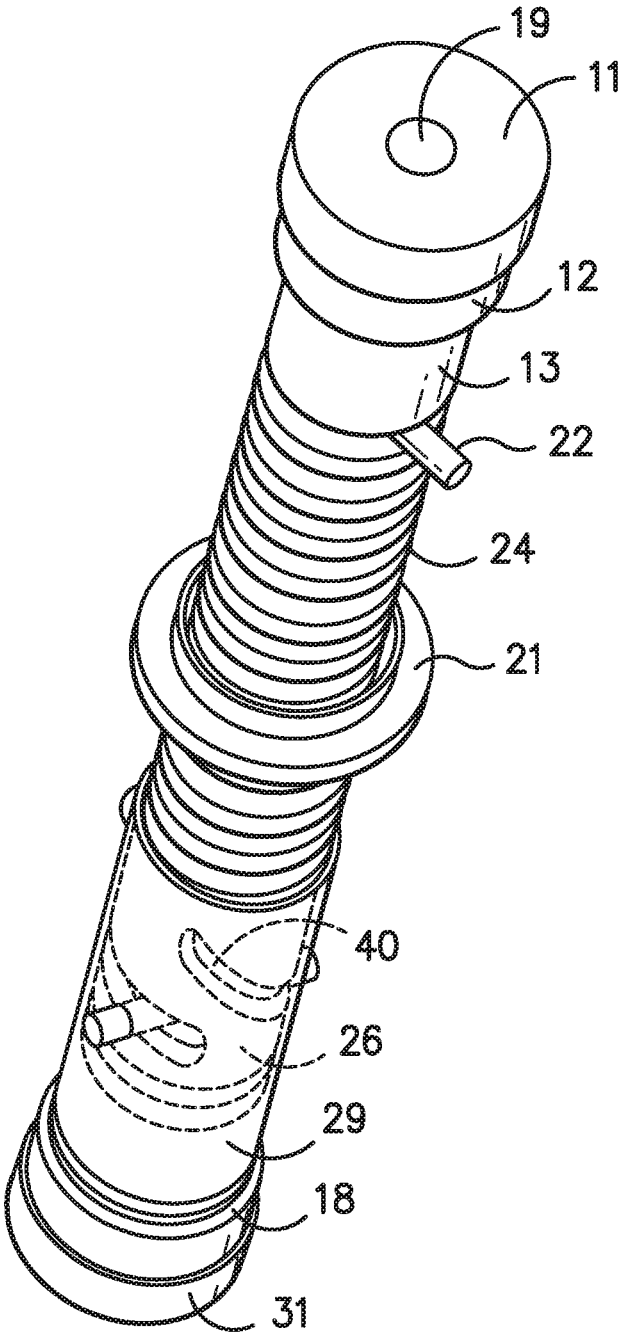
FIG. 6 is a perspective view illustrating one embodiment of the hydraulic system of the present invention.
Figure 7:
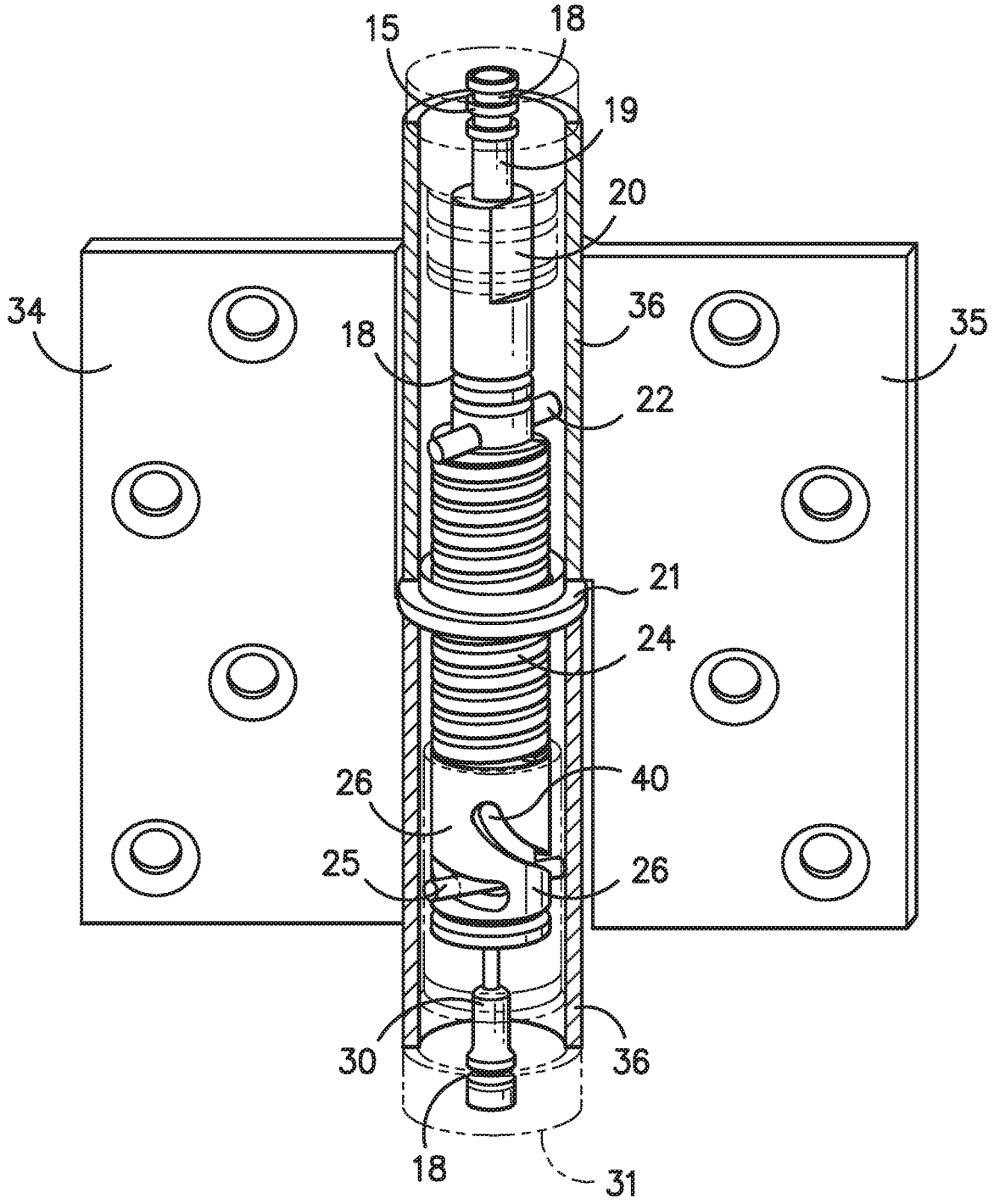
FIG. 7 is a perspective cutaway view illustrating one embodiment of the door hinge including the compression spring system and hydraulic system of the present invention.

In a preferred embodiment, the hinge 10 of the present invention provides a variable hydraulic damping speed control with spring action closing, as well as an optional stop mechanism. FIGS. 1-9 illustrate a preferred embodiment of the door hinge 10 disclosed herein. An exploded view of the preferred assembly of one embodiment of the hinge 10 and its components is shown in FIG. 1. FIGS. 2-3 show the hinge 10 in both a closed and semi-open position. FIG. 5 illustrates one embodiment of the top cap 11 of the hinge 10, whereby the tension on the compression spring 24 may be adjusted; and, FIG. 4 illustrates one embodiment of the bottom cap 31, whereby the resistance provided by the hydraulic damper may be adjusted.

As shown in FIG. 5, one embodiment of the hinge 10 includes a pair of leaves 34 and 35 that are attachable to a door and a door frame, wherein the leaves 34 and 35 extend outwardly from the central cylinder 36 of the hinge 10. At the top of the central cylinder 36 is a top cap 11, which houses an adjustment mechanism for adjusting tension on the compression spring 24. The top cap 11 is seated above a shaft casing 12. Within the shaft casing 12 is a bearing ring 13 operably connected to a shaft sleeve 14, a ball bearing ring 16 seated in a bearing ring placement groove 15, a bearing O-ring 17, and an oil seal 18, to form an upper rotatable assembly that allows the upper portion of the hinge 10 to pivot between an open and closed position, as shown in FIG. 1. A leaf ring 21 is disposed between the leaves 34 and 35. An adjustment pin 19 is disposed axially through the center of the upper rotatable assembly, and includes a threaded portion on a lower end, as shown in FIG. 1. The adjustment pin 19 extends upwardly to a central hole in the top cap 11 for access by a user. The lower portion of the adjustment pin 19 is threaded, and extends through a axially oriented, threaded hole within a rotation control mechanism 20, so that a user may turn the adjustment pin 19, preferably using a hexagonal wrench, screwdriver or other similar tool to adjust the tension of the spring 24 in the upper portion of the central cylinder 36 of the hinge 10. The rotation control mechanism 20 includes a longitudinal slot 37 adapted to receive a press pin 22 for spring control, and further includes a ribbed portion 38 at a lower end thereof, which is received by the upper portion of the control cylinder 26, which has a complementary shape to the ribbed portion 38 of the rotation control mechanism, so that the rotation control mechanism 20 is fixed with respect to the control cylinder 26. When a user turns the adjustment pin 19, that action rotates the rotation control mechanism 20 with respect to the control cylinder 26 and, depending upon the direction of rotation, lower end of the adjustment pin 19 either extends into or retracts from the slot 37 and comes into contact with the press pin 22. When the adjustment pin 19 is screwed downwardly, it pushes the press pin 22 downwardly, which in turn compresses the compression spring to increase tension on the spring, which increases the speed at which the door closes. The press pin 22 is disposed above the compression spring 24, so that adjusting the rotation control mechanism 20 serves to either force the spring 24 downwardly (increasing tension on the spring 24) or to allow the spring 24 to relax in an upward direction and extend, (decreasing tension on the spring 24). In this manner, the tension on the spring 24, and thus the force imparted by the hinge 10 upon the attached door may be adjusted as desired by a user. The rotation control mechanism is fixed with respect to the right leaf 35 by means of a flat edge (a cross-sectional "D" shape) on one side of the top portion thereof that engages a correspondingly "D" shaped opening in the axis of the shaft casing. In this way, the right leaf 35 remains fixed with respect to the rotation control mechanism 20. Additionally, a threaded pin 33 extends through a threaded hole in a side portion of central cylinder 36 of right leaf 35, as shown in FIG. 1. This threaded pin is tightened down against the hydraulic cover 23, so that the right leaf 35 is also fixed with respect to the hydraulic cover 23.

The lower portion of the door hinge assembly, as shown in FIGS. 1 and 6-9, is housed within the hydraulic cover 23, and is collectively referred to as a hydraulic damper 39 (shown in FIG. 9), comprising the control cylinder 26 having a pair of spiral slots 40 positioned on an outer portion thereof, the control cylinder 26 being disposed within an outer casing 29, and wherein a fixed opening distance control pin 28 extends through the spiral slots 40. The outer casing 29 also includes an oil seal 18 disposed laterally about an outer portion thereof, and includes a hole to receive the control pin 28, which remains fixed with respect to the outer casing 29. The control pin 28, in one embodiment, may include a pair of sleeves 25 that are hollow in a longitudinal direction, so that the control pin 28 slides into the sleeves 25. In this way, the sleeves act as ball bearings, each one rolling within the spiral slot as the hinge opens and closes. A hydraulic pin 30 extends axially and upwardly from a centrally located hole in the bottom cap 31 at one end, and is operably connected to the control cylinder 26 at the other end. The hydraulic pin 30 is threaded, and may be rotated by a user, which adjusts the hydraulic pressure for the hydraulic damper 39, so that the hydraulic damper 39 may apply more or less force to the opening and closing of the door. When the hydraulic pin 30 is rotated, the control cylinder 26 is moved upwardly or downwardly (depending upon the direction of rotation), the spiral slots 40 rotate with the fixed opening distance control pin 28 extending therethrough, causing the control cylinder 26 to move upwardly or downwardly in a spiraling manner, thereby increasing or decreasing hydraulic pressure therein. The outer casing 29 is fixed with respect to the left leaf 34, so that when the left leaf 34 rotates with respect to the right leaf 35, the outer casing 29 and fixed distance opening control pin 28 rotate along with the left leaf, while the control cylinder remains fixed with respect to the right leaf 35.

In the bottom portion of the hydraulic damper 39, hydraulic fluid is disposed in a fluid chamber defined by the cap 31 and a plunger (not shown). The plunger is disposed below (or as part of) the control cylinder 26, and is operatively connected to the hydraulic pin 30. The hydraulic pin 30 is threaded, and fits through a threaded hole in the bottom cap 31, so that when the hydraulic pin 30 is rotated in one direction, it raises the plunger and control cylinder, which provides more volume within the fluid chamber, and thus provides less resistance to the closing of the door during the last 15 to 20 degrees or so of the door closing (thereby causing the door closing speed to increase). Conversely, when the hydraulic pin is rotated in the other direction, the volume of the fluid chamber is decreased, thereby creating more hydraulic pressure to resist the closing of the door, which makes the door close more slowly during the last 15 to 20 degrees or so of the door closing.

Figure 8:
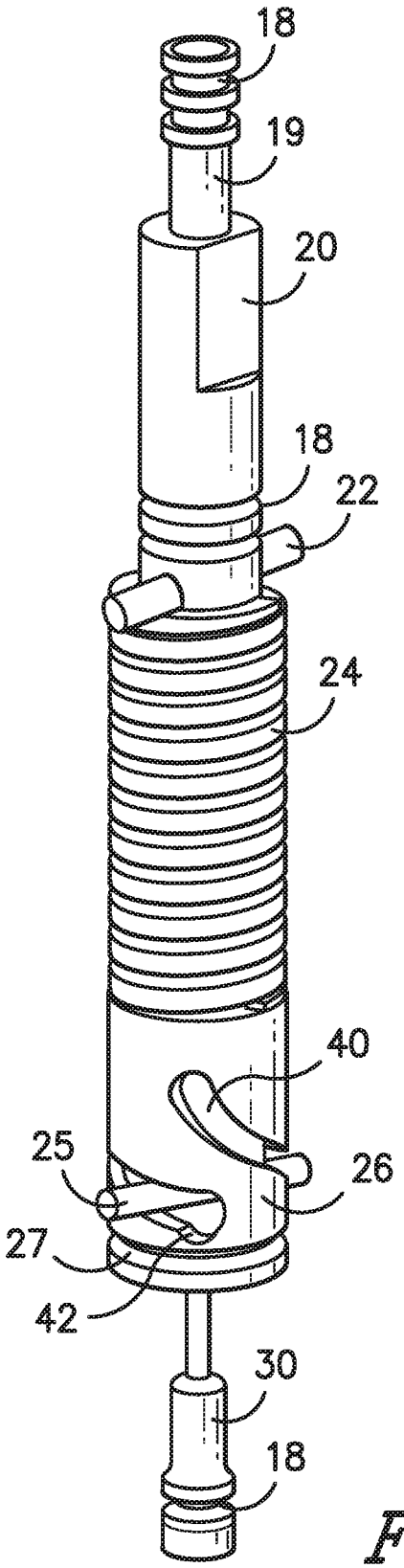
FIG. 8 is a perspective view illustrates one embodiment of the compression spring system and hydraulic system of the present invention.
Figure 9:
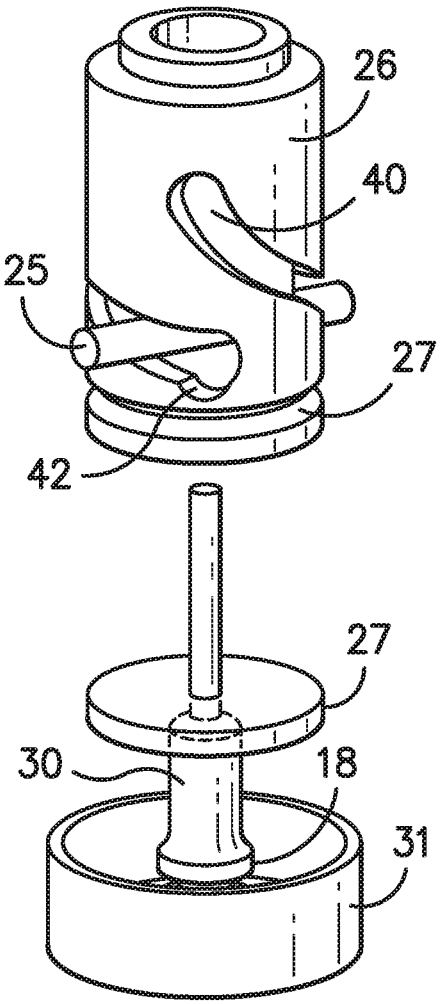
FIG. 9 is a perspective exploded view illustrating one embodiment of the control cylinder that receives and rotates about the hydraulic pin, which is attached to the bottom cap.

In one optional embodiment of the present door hinge 10, a stopper mechanism is incorporated into the assembly, which disengages the closing forces of both the compression spring 24 and the hydraulic damper 39 within a certain or desired range (for instance, when the door is between about 85 degrees open to about 175 degrees open). The stopper mechanism allows the door to be open within that range, and to remain open with no closing forces acting upon it from the hinge assembly. In this embodiment, the spiral groove 40 may include an indentation 42 at a bottom portion thereof, where the distance control pin 28 may become seated, as shown in FIGS. 8 and 9. This arrangement allows the hinge 10 to have a stopper function, which provides that no forces are acting on the hinge 10 (neither the compression spring 24, nor the hydraulic damper 39 acts on the hinge when the control pin 28 is seated in the indentation 42 of the spiral groove 40), so that the door will remain open in that position (or anywhere from between about 85 degrees to roughly 175 degrees, or as otherwise desired). When the distance control pin 28 is seated in the indentation 42, the door is stopped with no force acting upon it from the hinge 10.

As the hinge 10 of the present invention is affixed to a door and structure door frame and pivots about an axis during opening and closing, the compression spring 24 can store and release energy during operation to facilitate opening and closing of the door. The hydraulic damper 39 is operatively connected to the compression spring 24 and includes a rotational control mechanism 20 with a control cylinder 26 disposed generally parallel to the pivotal axis for controlling the speed of the door as it closes.

In use, the compression spring 24 is biased toward keeping the hinge 10 and door in a closed position, and the hydraulic damper 39 reduces or dampens the force to the closing of the hinge 10 and door when the door is in a slightly opened position (in a range of 0 to 20 degrees, for instance, in a preferred embodiment, although other ranges could be imparted). The concept is that when the door is closing, from a 90 degree open position (for instance), the compression spring 24 applies force to close the door at a certain speed which forces the control cylinder downwardly so that it rotates in a spiraling manner due to the spiral slot that is engaged with the fixed distance opening control pin 28 until the door reaches a user-specified range (20 degrees open, in a preferred embodiment), and then the hydraulic damper 39 applies force against the spring to slow down the closing of the door, in order to ensure that the door closes properly and fully without slamming. Similarly, the force applied by the hydraulic damper 39 and the compression spring 24 serves to slow the opening of the door from 0-20 degrees, and then beyond 20 degrees, the hydraulic damper 39 ceases to act on the hinge 10, and the compression spring 24 is the only force biasing the hinge 10 toward a closed position.

In another embodiment, the hydraulic damper 39 may be configured to disengage during the last 5 degrees or so (or at any point, as desired) before the door fully closes, in order to apply additional force to the closing of the door just prior to closing. In this way, for example, when the door is closing from 90 degrees, the compression spring 24 acts on the door at a first speed, then at around 20 degrees, the hydraulic damper 39 slows the rate of closure of the door, and then at 5 degrees, the hydraulic damper 39 disengages, and the speed of the door closing increases due to the now unencumbered force applied by the compression spring 24, in order to provide enough force to ensure that the door closes properly. A pair of magnets 27 may be used to impart this late disengagement of the hydraulic dampener 39, to speed up the closing of the door over the last 5 degrees. The first magnet 27 is disposed at the bottom portion of the hydraulic damper 39 and is fixed thereto, and the second magnet 27 is disposed adjacent the bottom cap 31, as shown in FIGS. 8 and 9. When the hydraulic damper 39 reaches a selected position (5 degrees from closing, for instance), the force between the magnets 27 causes the hydraulic damper 39 to slide downwardly until the magnets 27 come into contact with each other. This action disengages the hydraulic damper 39, which increases the speed at which the door closes during the last few degrees of door rotation to the closed position.

FIG. 9 illustrates a preferred embodiment of the control cylinder 26 of the present invention. The control cylinder 26 works to control the opening and closing distance of the hinge 10. Distance control pin 28 is fixed, and the control cylinder rotates spirally through the spiral slots 40 to adjust the opening and closing distance. When the distance control pin 28 is closer to the distal end of the control cylinder 36, the door is in a more closed position; when the distance control pin 28 is closer to the proximal or upper end of the control cylinder 36, the door is in a more open position. As the door is closing, the control cylinder is moving downwardly until the distance control pin 28 reaches the top of the spiral slots 40, at which time the plunger begins to put pressure on the hydraulic fluid within the fluid chamber (within about the last 15 to 20 degrees of rotation before the door is completely closed), and the resistance provided by the hydraulic fluid being compressed within the fluid chamber slows the door down from the higher speed provided by the compression spring.

Although the foregoing description and accompanying drawings relate to specific preferred embodiments of the present invention as presently contemplated by the inventor, it will be understood that various changes, modifications and adaptations, may be made without departing from the spirit of the invention.

What is claimed is:

1. An adjustable, self-closing door hinge comprising:

a central cylinder haying an upper portion and a lower portion, wherein said upper portion and lower portions thereof may rotate about a central axis in opposed directions;

an upper leaf connected to said upper portion of said central cylinder;

a lower leaf connected to said lower portion of said central cylinder, wherein said lower leaf and said upper leaf are in pivoting relation between an open position and a closed position, a compression spring positioned within said central cylinder for imparting a force to bias said upper leaf and said lower leaf toward a closed position;

a hydraulic damper mechanism positioned within said lower portion of said central cylinder for imparting a force against said compression spring within a defined range when said upper leaf and said lower leaf are positioned between a 90 degree angle and a 0 degree angle;

wherein said hydraulic damper mechanism includes a control cylinder having a spiral slot positioned on an outer portion thereof and a fixed opening distance control pin extending through said spiral slot and fixed with respect to said lower leaf, so that said compression spring applies a force against said control cylinder, forcing said control cylinder to rotate; and wherein rotation of said control cylinder causes said control cylinder o move downwardly to compress a hydraulic fluid within said central cylinder when said hinge is moving toward a closed position as said control cylinder rotates due to said fixed pin disposed in said spiral slot.

2. The adjustable, self-closing door hinge set forth in claim 1, wherein a spring adjustment mechanism for increasing and decreasing tension on said compression spring is positioned within said central cylinder so that a user may adjust an amount of force applied to said hinge ley said compression spring.

3. The adjustable, self-closing door hinge set forth in claim 2, wherein a hydraulic adjustment mechanism for increasing and decreasing force applied to said hinge by said hydra damper is positioned within said central cylinder so that a user may adjust an amount of force applied to said hinge by said hydraulic damper.

4. The adjustable, self-closing door hinge set forth in claim 3, further including a top cap positioned on an upper end of said upper portion of said central cylinder, said top cap defining a hole therein; and a bottom cap positioned. on a lower end of said lower portion of said central cylinder, said bottom cap defining a hole therein.

5. The adjustable, self-closing door hinge set forth in claim 4, wherein said spring adjustment mechanism is accessible by a user through said hole disposed in said top cap, and wherein said hydraulic adjustment mechanism is accessible by a user through said hole disposed in said bottom cap.

6. The adjustable, self-closing door hinge set forth in claim 2, wherein said spring adjustment mechanism comprises:

an adjustment pin having a threaded portion on a lower end thereof is received by a threaded hole in an upper portion of a rotation control mechanism, said adjustment pin disposed axially through said upper portion of said central cylinder;

said rotation control mechanism defining a longitudinal slot therein, and said adjustment pin extends into said longitudinal slot;

a press pin disposed within said longitudinal slot of said rotation control mechanism, said press pin being positioned above said compression spring, and said press pin is in contact with a bottom of said adjustment pin;

so that when said adjustment pin is rotated in a first direction, the press pin is forced downwardly within said longitudinal slot against said compression spring, thereby increasing tension on said compression spring which increases force biasing said hinge toward a closed position, and conversely, so that when said adjustment pin is rotated in a second direction, the press pin moves upwardly, thereby decreasing tension on said compression spring, thus decreasing force biasing said hinge toward a closed position.

7. The adjustable, self-closing door hinge set forth in claim 3, wherein said hydraulic adjustment mechanism comprises:

a hydraulic pin extending axially through said lower portion of said central cylinder;

said hydraulic pin being operatively connected to said control cylinder, so that rotation of said hydraulic pin rotates said control cylinder, so that when said hydraulic pin is rotated in a first direction, said hydraulic damper applies more dampening force against said compression spring, thus slowing the rate of closure of said door, while rotating said hydraulic pin in a second direction applies less dampening force against said compression spring, thus accelerating the rate of closure of said door.

8. The adjustable, self-closing door hinge set forth in claim 1, wherein said spiral slot includes an indentation at a bottom portion thereof, said indentation being oriented downwardly away from said spiral slot, so that when said fixed opening distance control pin is seated in said indentation, said compression spring and said hydraulic damper are disengaged from said hinge, providing no biasing forces on said hinge.

9. The adjustable, self-closing door hinge set forth in claim 1, further including a first magnet positioned at a bottom portion of said hydraulic damper, and a second magnet positioned adjacent a lower end of said lower portion of said central cylinder, said magnets oriented to attract one another, so that said second magnet provides additional downward force to said hydraulic damper, in order to disengage the effect of said hydraulic damper when said first leaf and said second leaf are oriented between about 5 degrees and about 0 degrees from one another.

* * * * *